US006711493B1

(12) United States Patent
Andrews et al.

(10) Patent No.: US 6,711,493 B1
(45) Date of Patent: Mar. 23, 2004

(54) METHOD AND APPARATUS FOR COLLECTING AND PROPAGATING INFORMATION RELATING TO TRAFFIC CONDITIONS

(75) Inventors: James Neal Andrews, Austin, TX (US); David Bruce Kumhyr, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/314,856

(22) Filed: Dec. 9, 2002

(51) Int. Cl.[7] ..... G06G 7/76

(52) U.S. Cl. ..... 701/117; 701/118; 701/119; 340/903; 340/904

(58) Field of Search ..... 701/117, 213, 701/118, 119; 340/935, 937, 933, 903, 435, 902, 904

(56) References Cited

U.S. PATENT DOCUMENTS

| | | | | |
|---|---|---|---|---|
| 5,428,544 A | | 6/1995 | Shyu | 364/436 |
| 5,953,672 A | | 9/1999 | Lengdell et al. | 455/517 |
| 6,150,961 A | | 11/2000 | Alewine et al. | 340/995 |
| 6,252,520 B1 | | 6/2001 | Asami et al. | 340/903 |
| 6,292,747 B1 | | 9/2001 | Amro et al. | 701/213 |
| 6,304,816 B1 | | 10/2001 | Berstis | 701/117 |
| 6,369,720 B1 | | 4/2002 | Wilhelm | 340/905 |
| 6,397,141 B1 | | 5/2002 | Binnig | 701/117 |
| 6,594,576 B2 | * | 7/2003 | Fan et al. | 701/117 |
| 2002/0062190 A1 | * | 5/2002 | Hameleers et al. | 701/117 |

FOREIGN PATENT DOCUMENTS

| | | | |
|---|---|---|---|
| JP | 4297000 | 10/1992 | G08G/1/09 |
| JP | 5266399 | 10/1993 | G08G/1/16 |
| JP | 2001283381 | 10/2001 | G08G/1/09 |

OTHER PUBLICATIONS

Kojima et al., "Inter–Vehicle Communication Network with an Autonomous Relay Access Scheme", IEICE Trans. Commun., vol. E84–B, No. 3, Mar. 2001, pp. 566–575.

Maeda et al., "Adaptive Channel Access Protocol for Asynchronous Inter–Vehicle Communication Network Using Spread Spectrum", Personal, Indoor and Mobile Radio Communications, vol. 3, 1997, pp. 928–932.

Young–an et al., "R–ALOHA Protocol for SS Inter–Vehicle Communication Network Using Head Spacing Information", Intelligent Vehicles Symposium, 1996, pp. 278–283.

Widodo et al., "Impacts of Environment Adaptive Running with and Without IVCN", Vehicular Technology Conference Proceedings, 2000, vol. 1, pp. 327–330.

* cited by examiner

*Primary Examiner*—Marthe Y. Marc-Coleman
(74) *Attorney, Agent, or Firm*—Duke W. Yee; Jeffrey S. LaBaw

(57) ABSTRACT

A method, apparatus, and computer instructions for processing traffic information. Traffic related conditions at a plurality of vehicles are detected. A set of traffic data packets using the traffic related conditions detected at the plurality of vehicles is produced in which a time stamp and a location stamp are assigned to each of the set of traffic data packets. Data traffic packets are passed between vehicles in which packets within the set of traffic data packets having an expired time stamp are no longer passed between the vehicles.

32 Claims, 4 Drawing Sheets

CPU
302
MEMORY
304
STORAGE DEVICE UNIT
306
I/O UNIT
308
DISPLAY ADAPTER
322
SPEECH I/O
326
GPS RECEIVER
310
312
316
WIRELESS UNIT
314
INERTIAL NAVIGATION UNIT
318
SENSORS
320
330
300
324
328

TRAFFIC DATA PROCESS
FILTER
404
400
TRAFFIC DATA PACKETS
402
406
TRAFFIC DATA PACKETS 502
504
ROUTING INFORMATION
TRAFFIC RELATED CONDITIONS
LOCATION
TIME STAMP
500
506
508
510
512

METHOD AND APPARATUS FOR COLLECTING AND PROPAGATING INFORMATION RELATING TO TRAFFIC CONDITIONS

BACKGROUND OF THE INVENTION

1. Technical Field

The present invention relates generally to an improved data processing system and in particular to a method and apparatus for processing data. Still more particularly, the present invention relates to a method and apparatus for collecting and passing data regarding traffic conditions through a distributed automotive computing system.

2. Description of Related Art

The use of computers has become more and more pervasive in society. This pervasiveness includes the integration of personal computers into vehicles, such as automobiles. The utilization of computer technology is employed to provide users or drivers with a familiar environment. In this manner, a user's ability to easily use computing resources in an automobile is provided. In addition, it is envisioned that car buyers would be able to use most of the same software elements in an automobile that are used at home or in the office. In addition, an automobile owner could completely customize driver information displays to create an optimal environment for the driver's needs. Various platforms have been developed and are being developed for use in automobiles. Many platforms provide the computing strength of a personal computer platform using widely recognized as well as emerging technologies. Widely accepted technologies that may be implemented within an automobile include, cellular/global system for mobile communications (GSM), global positioning system (GPS), and radio data broadcast (RDB). These devices allow a driver to navigate, receive real-time traffic information and weather forecasts, access databases of personalized information, and place and receive telephone calls, as well as send and receive email and faxes from an automobile. Emerging technologies that are being integrated into computing platforms for automobiles include the universal serial bus (USB) and the digital video disk (DVD).

Another key feature for adapting computer technologies for use in an automobile is a voice recognition interface (VUI) for the driver along with a more conventional graphical user interface (GUI) for passengers. Voice recognition technology is already well developed in multi-media desktop personal computers. For example, VoiceType family products available from International Business Machines Corporation also may be used in the automobile. Voice recognition technology would allow drivers to easily control and interact with onboard computers and telephone applications, including productivity software, Internet browsers, and other applications while allowing the driver to keep their hands on the wheel and their eyes on the road. Such productivity is especially important when some surveys show that up to twelve percent of a person's waking life is spent in an automobile.

When traveling, a driver typically does not know the details of conditions ahead of the driver, such as weather, traffic delays, and accidents. Further, these conditions may rapidly change such that traffic reports on the radio or other broadcast systems are neither timely enough or localized enough for the driver. Computing systems are currently being developed for automobiles to guide drivers from point A to point B using information, such as GPS data, traffic data, and weather data as well as provide information on traffic conditions. With all of this data being collected and transmitted, congestion may occur in the network data processing system handling traffic data as well as other types of data used by pervasive computing devices, such as computers integrated into automobiles.

Therefore, it would be advantageous to have an improved method and apparatus for handling data relating to traffic conditions in a network data processing system.

SUMMARY OF THE INVENTION

The present invention provides a method, apparatus, and computer instructions for processing traffic information. Traffic related conditions at a plurality of vehicles are detected. A set of traffic data packets using the traffic related conditions detected at the plurality of vehicles is produced in which a time stamp and a location stamp are assigned to each of the set of traffic data packets. Data traffic packets are passed between vehicles in which packets within the set of traffic data packets having an expired time stamp are no longer passed between the vehicles.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
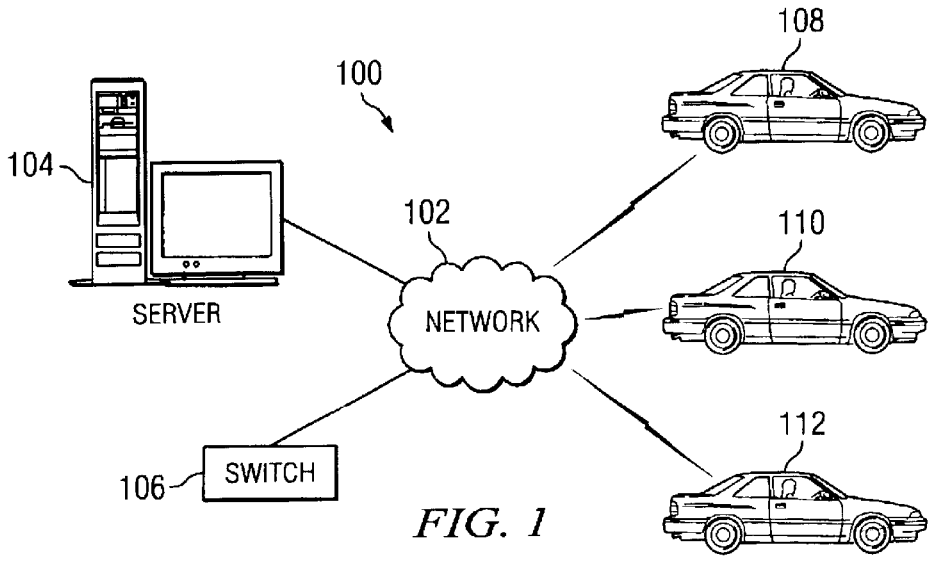
FIG. 1 depicts a pictorial representation of a network of data processing systems in which the present invention may be implemented.

With reference now to the figures, FIG. 1 depicts a pictorial representation of a network of data processing systems in which the present invention may be implemented. Network data processing system 100 is a network of computers and other pervasive computing devices in which the present invention may be implemented. Network data processing system 100 contains network 102, which is the medium used to provide communications links between various devices and computers connected together within network data processing system 100. Network 102 may include connections, such as wire, wireless communication links, or fiber optic cables.

In the depicted example, server 104 is connected to network 102. Switch 106 also is connected to network 102 and provides routing functions for data. In addition, vehicles 108, 110, and 112 are in communication with network 102. These vehicles, vehicles 108, 110, and 112, contain computing devices and may receive data regarding traffic conditions as well as other types of data. In the depicted example, server 104 serves as a component to collect and transfer data to different clients, such as vehicles 108, 110, and 112. Network data processing system 100 may include additional servers, clients, and other devices not shown. Vehicles 108, 110, and 112 may take various forms, such as, for example, automobiles, trucks, boats, and airplanes.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, government, educational and other computer systems that route data and messages. Wireless communications with vehicles, such as vehicles 108, 110, and 112 may be accomplished through various known wireless communication protocols. In these examples, a short distance transmission medium in the form of a wireless personal area network (PAN) is employed. One PAN protocol that may be used is Bluetooth, which is an open standard for short-range transmission of digital voice and data between mobile devices and desktop devices. This standard supports point-to-point and multipoint applications.

Of course, network data processing system 100 also may be implemented as a number of different types of networks, such as for example, an intranet, a local area network (LAN), or a wide area network (WAN). FIG. 1 is intended as an example, and not as an architectural limitation for the present invention.

The present invention provides a method, apparatus, and computer implemented instructions using a network data processing system, such as network data processing system 100, to collect and propagate data concerning traffic conditions. Vehicles in network data processing system 100 sense traffic conditions and produce traffic data packets. These traffic data packets also include a time stamp and location information as well as information descriptive of the sensed traffic conditions. These traffic data packets are passed between different vehicles through network 102 using a short distance transmission medium in these examples.

These traffic data packets are examined to determine whether the traffic data packets should continue to be propagated within network data processing system 100. For example, the time stamp is examined to determine whether the data is too old to be useful. Traffic data packets that are too old are dropped and are no longer passed to different vehicles in network data processing system 100. In this manner, congestion within network data processing system 100 due to large amounts of data may be reduced through the elimination of data that is no longer useful. Data packets may be examined based on a set amount of time that has passed since the data packet was generated or using the time stamp along with the type of data. For example, all traffic data packets may be dropped after two minutes. Alternatively, the amount of time after which a data packet is dropped may depend on the type of data. Data identifying the speed of a vehicle may be dropped after two minutes while data indicating weather conditions may be dropped after fifteen minutes.

The examination of these packets may take place in different components within network data processing system 100. For example, in one embodiment, the examination of traffic data packets may be performed by server 104 or switch 106. In another embodiment, this examination may take place in each of vehicles 108, 110, and 112. Such a transmission system is especially useful with short distance transmission mediums, such as Bluetooth. Only vehicles within a selected geographic proximity would receive a transmitted or retransmitted traffic data packet. This geographic proximity is defined by the range of the transmission medium in these examples. For example, a traffic data packet indicating a presence of a traffic slowdown at a particular intersection would be received only by other vehicles within the transmission range of the vehicle generating the traffic data packet. Of course, this traffic data packet could propagate large geographic distances depending on what vehicles are present. In such a case, an additional examination may be made to determine whether the geographic location of the traffic slowdown is relevant to a vehicle. Factors such as the particular road and direction may be used in this type of examination. In this manner, the mechanism of the present invention provides for timely and geographically useful information on various traffic conditions.

Figure 2:
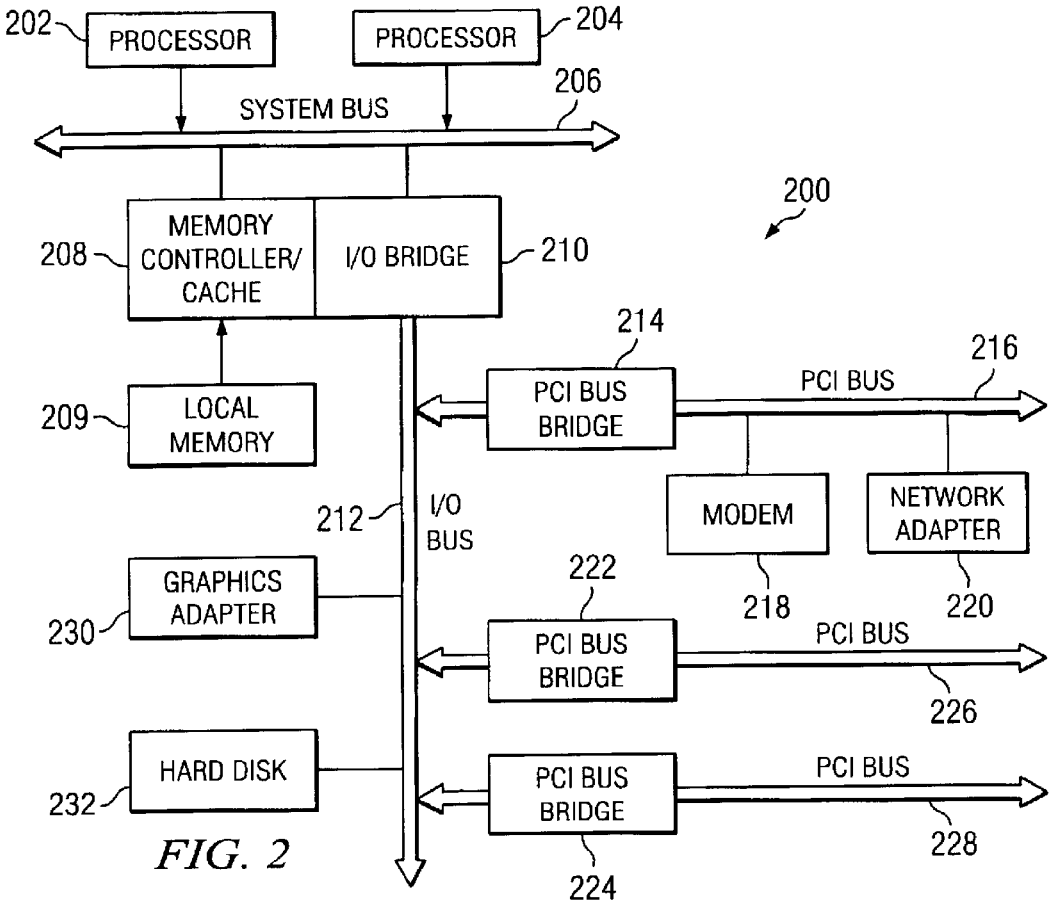
FIG. 2 is a block diagram depicting a data processing system in accordance with a preferred embodiment of the present invention.

Referring to FIG. 2, a block diagram depicts a data processing system, which may be implemented as a server, such as server 104 in FIG. 1, in accordance with a preferred embodiment of the present invention. Data processing system 200 may be a symmetric multiprocessor (SMP) system including a plurality of processors 202 and 204 connected to system bus 206. Alternatively, a single processor system may be employed. Also connected to system bus 206 is memory controller/cache 208, which provides an interface to local memory 209. Input/output (I/O) bus bridge 210 is connected to system bus 206 and provides an interface to I/O bus 212. Memory controller/cache 208 and I/O bus bridge 210 may be integrated as depicted.

Peripheral component interconnect (PCI) bus bridge 214 connected to I/O bus 212 provides an interface to PCI local bus 216. A number of I/O devices, such as modem 218 and network adapter 220, may be connected to PCI bus 216. Typical PCI bus implementations will support four PCI expansion slots or add-in connectors. Communications links to transmitters in FIG. 1 may be provided through modem 218 and network adapter 220 connected to PCI local bus 216 through add-in boards.

Additional PCI bus bridges 222 and 224 provide interfaces for additional PCI buses 226 and 228, from which additional modems or network adapters may be supported. In this manner, server 200 allows connections to multiple network computers. A memory-mapped graphics adapter 230 and hard disk 232 may also be connected to I/O bus 212 as depicted, either directly or indirectly.

Those of ordinary skill in the art will appreciate that the hardware depicted in FIG. 2 may vary. For example, other peripheral devices, such as an optical disk drive and the like, also may be used in addition to or in place of the hardware depicted. The depicted example is not meant to imply architectural limitations with respect to the present invention.

The data processing system depicted in FIG. 2 may be, for example, an IBM RISC/System 6000 system, a product of International Business Machines Corporation in Armonk, N.Y., running the Advanced Interactive Executive (AIX) operating system.

Figure 3:
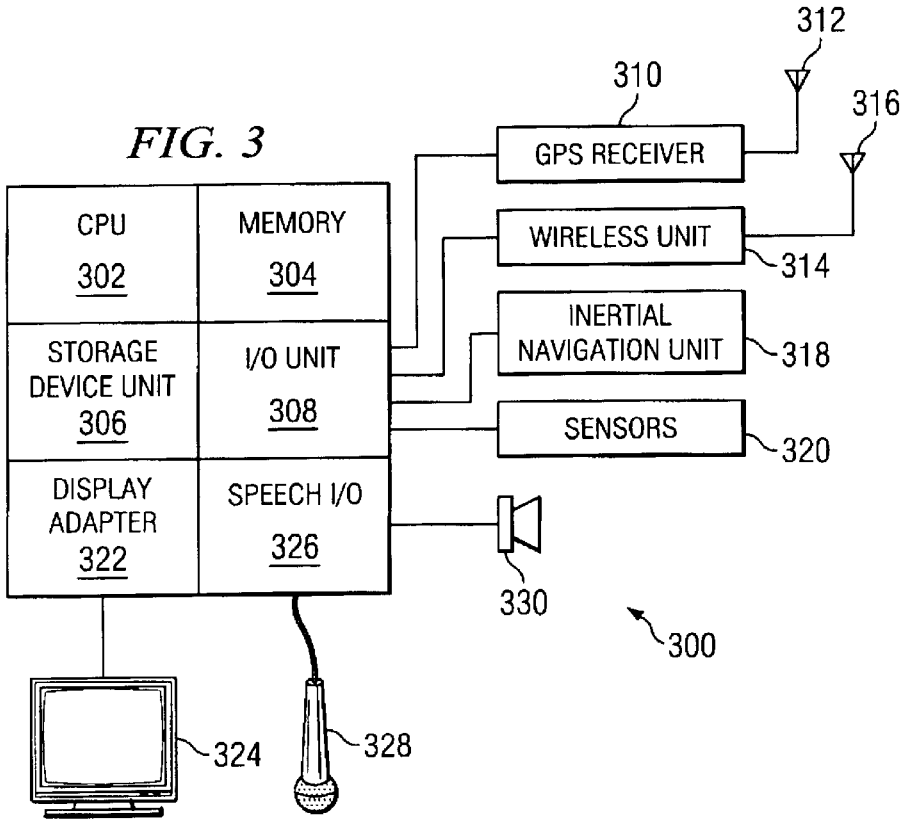
FIG. 3 is a block diagram of an automotive computing platform in accordance with a preferred embodiment of the present invention.

Turning next to FIG. 3, a block diagram of an automotive computing platform is depicted in accordance with a preferred embodiment of the present invention. Computing platform 300 is located within a vehicle, such as vehicle 108 in FIG. 1. Computing platform 300 includes a CPU 302, which may be an embedded processor or processor such as a Pentium processor from Intel Corporation. "Pentium" is a trademark of Intel Corporation. Computing platform 300 also includes memory 304, which may take the form of random access memory (RAM) and/or read only memory (ROM).

Computing platform 300 also contains a storage device unit 306. Storage device unit 306 may contain one or more storage devices, such as, for example, a hard disk drive, a flash memory, a DVD drive, or a floppy disk. Computing platform 300 also includes an input/output (I/O) unit 308, which provides connections to various I/O devices. In this example, a GPS receiver 310 is included within computing platform 300 and receives signals through antenna 312. Wireless unit 314 provides for two-way communications between computing unit 300 and another data processing system, such as sever 104 in FIG. 1. Communications are provided through antenna 316. In addition, inertial navigation unit 318 is connected to I/O unit 308. Inertial navigation unit 318 is employed for navigation when GPS receiver 310 is unable to receive a usable signal or is inoperable.

A multitude of different sensors 320 also are connected to I/O unit 308. These sensors may include sensors that detect speed, unusually high acceleration forces, airbag deployment, extensive speed up and slow down cycles, dropping out of cruise control, brake use, anti-lock brake occurrences, traction control use, windshield wiper use, turning on or off of lights for the automobile, and outside light levels. In addition, sensors 320 may include sensors for detecting steering wheel movement, temperature, the state of door locks, and the state of windows. In other words, almost any condition or parameter about or around an automobile may be detected through the use of sensors 320.

Computing platform 300 also includes a display adapter 322, which is connected to display 324. In the depicted example, this display is a touch screen display. Alternatively or in addition to a touch screen display, display 324 also may employ a heads-up display projected onto the windshield of the automobile. Computing unit 300 also includes a microphone 328 and a speaker 330 to provide a driver with the ability to enter commands and receive responses through speech I/O 326 without having to divert the driver's attention away from the road, or without the driver having to remove the driver's hands from the steering wheel.

Various computing platforms located on mobile units, such as automobiles and trucks, may report information collected from sensors located on the mobile units to a central database. This central database may be located at a computer, such as server 104 in network data processing system 100 in FIG. 1. In the depicted examples, traffic conditions are automatically detected and reported without requiring intervention from a user. In addition, user initiated reports sent to the central database also may be employed. The reports collected at the central database are compared to data regarding current traffic conditions. Differences between the current traffic conditions and the reported traffic conditions from the various computing platforms are identified. With these changes in conditions, updates may be returned to one or more of the mobile units. For example, these updates may include alerts regarding various hazardous road or weather conditions such as ice or heavy rain. The detection of ice or heavy rain may be indicated through the number of times various computing units report the occurrence of the use of anti-lock brakes, traction control, or high speed windshield wiper use.

Figure 4:
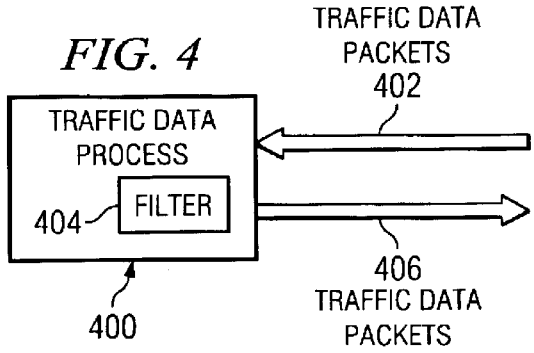
FIG. 4 is a diagram illustrating components used in handling traffic data packets in accordance with a preferred embodiment of the present invention.

With reference now to FIG. 4, a diagram illustrating components used in handling traffic data packets is depicted in accordance with a preferred embodiment of the present invention. Traffic data process 400 may be implemented in different components in a network data processing system. For example, traffic data process 400 may be implemented in server 104 or switch 106 in FIG. 1. This process also may be implemented in computing devices located in the vehicles. Further, this process could be located in other devices other than the ones illustrated in FIG. 1. For example, this process also may be implemented in a device, such as a mobile phone or personal digital assistant equipped with wireless communication and GPS capabilities. Traffic data packets 402 are received by traffic data process 400. These data packets are received from vehicles generating traffic data packets 402. In these examples, traffic data packets 402 are filtered using filter 404 to generate traffic data packets 406, which are sent or transmitted for use by vehicles within a network data processing system. Filter 404 is used to identify traffic data packets, which should no longer be propagated between different vehicles.

A time out may be associated with each traffic data packet. For example, a time stamp may be included in each traffic data packet that is examined by traffic data process 400 using filter 404. Traffic data packets that are older than a selected period of time are not sent out with traffic data packets 406. In this manner, traffic data packets, which are no longer useful, do not continue to propagate within a network data processing system, reducing congestion and delays in transmitting data within the network data processing system.

Figure 5:
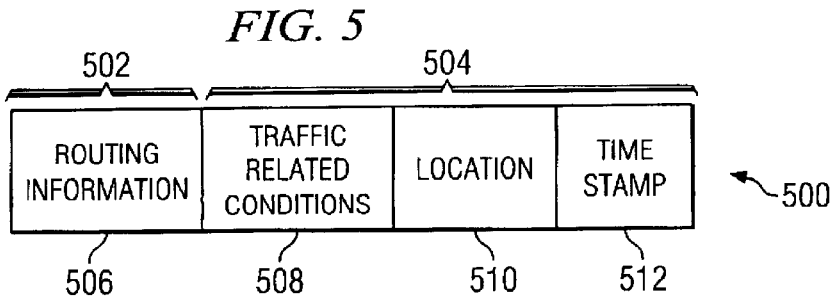
FIG. 5 is a diagram illustrating a traffic data packet in accordance with a preferred embodiment of the present invention.

Turning now to FIG. 5, a diagram illustrating a traffic data packet is depicted in accordance with a preferred embodiment of the present invention. Traffic data packet 500 is an example of a traffic data packet processed by traffic data process 400 in FIG. 4. Traffic data packet 500 includes header 502 and payload 504. Routing information 506, contained in header 502, is used to route and pass traffic data packet 500. Routing information 506 is unnecessary when a short distance transmission medium, such as Bluetooth, is employed. Payload 504 includes traffic related conditions 508, location 510, and time stamp 512. Location 510 includes information, such as the location of the data processing system generating data packet 500. Further, location 510 also may include information, such as a road and direction of travel. Location 510 is also referred to as a location stamp.

Figure 6:
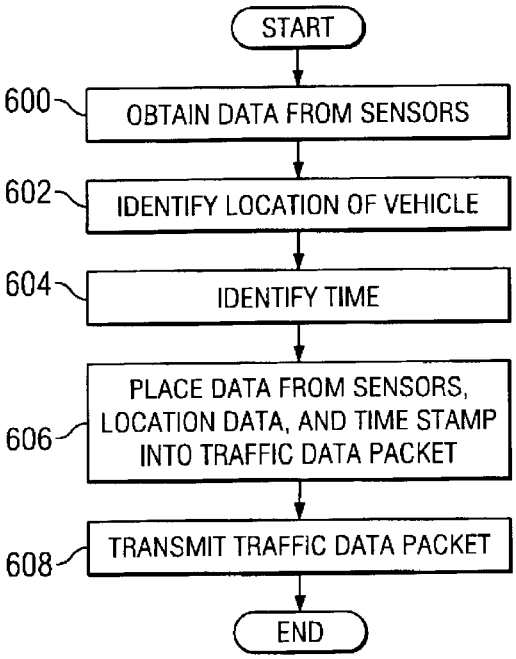
FIG. 6 is a flowchart of a process used for generating traffic data packets in accordance with a preferred embodiment of the present invention.

With reference now to FIG. 6, a flowchart of a process used for generating traffic data packets is depicted in accordance with a preferred embodiment of the present invention. The process illustrated in FIG. 6 may be implemented in a computing platform, such as computing platform 300 in FIG. 3.

The process begins by obtaining data from the sensors (step 600). This data may take various forms depending on the sensors employed. For example, information such as the speed of the vehicle, detection of deployment of an airbag, a sudden deceleration of the vehicle from 55 miles an hour to 0 miles an hour on the highway, the temperature, and the use of windshield wipers are some traffic related conditions that may be collected at a vehicle. The location of the vehicle is identified (step 602). This location information may be identified through a GPS device on the vehicle, such as the one described for computing platform 300 in FIG. 3. The time is identified (step 604). The data from the sensors, location data, and time stamp are placed into a traffic data packet (step 606). The traffic data packet is transmitted (step 608) and the process terminates thereafter.

Figure 7:
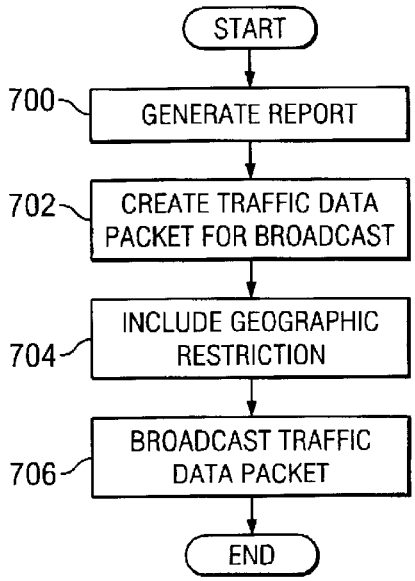
FIG. 7 is a flowchart of a process used for generating traffic data packets in accordance with a preferred embodiment of the present invention.

Turning now to FIG. 7, a flowchart of a process used for generating traffic data packets is depicted in accordance with a preferred embodiment of the present invention. The process illustrated in FIG. 7 may be implemented in a vehicle, such as vehicle 108 in FIG. 1.

The process begins by generating a report (step 700). The report may be one based on sensors in the vehicle or a message generated by a user. For example, the message may indicate that westbound traffic is restricted to the right lane at mile marker 278 on highway I40 by an accident. A traffic data packet is created for broadcast (step 702). This traffic data packet includes the message as well as a time stamp. A geographic restriction is included (step 704). In this example, the geographic restriction is based on a road and a location on the road. Further, the geographic restriction may be used in filtering such that only vehicles on highway I40 traveling in a westbound direction within 10 miles of mile marker 278 will display this message to a user. The traffic data packet is broadcast (step 706) and the process terminates thereafter. In this example, the message is broadcast using a short distance transmission medium, such as Bluetooth.

Figure 8:
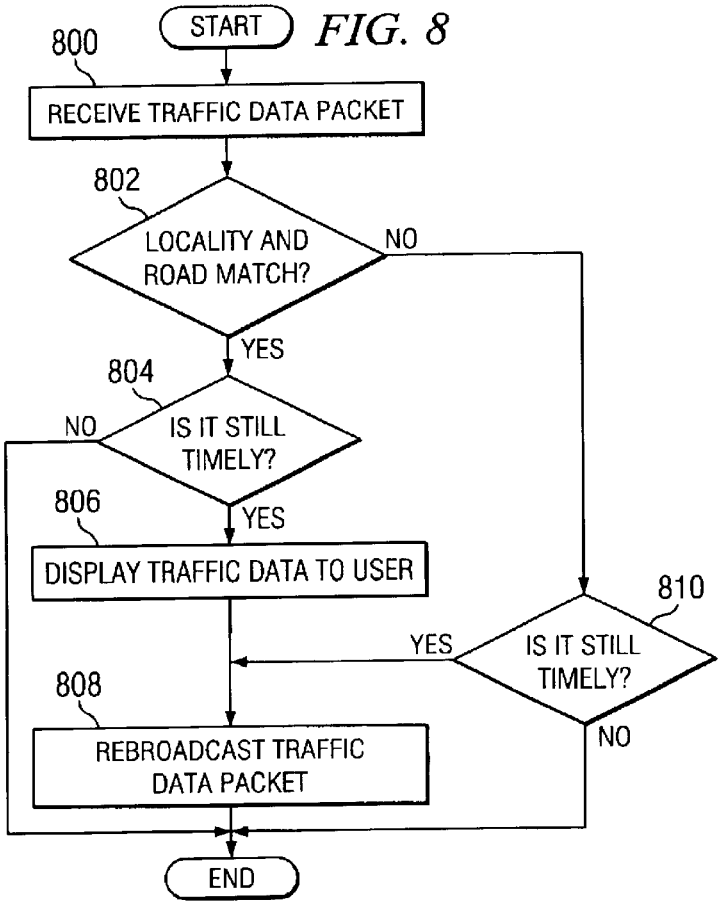
FIG. 8 is a flowchart of a process used for processing a traffic data packet in accordance with a preferred embodiment of the present invention.

With reference now to FIG. 8, a flowchart of a process used for processing a traffic data packet is depicted in accordance with a preferred embodiment of the present invention. The process illustrated in FIG. 8 may be implemented in a vehicle, such as vehicle 108 in FIG. 1.

The process begins by receiving a traffic data packet (step 800). A determination is made as to whether the locality and road match (step 802). In step 802, processing or filtering of the traffic data packet is performed to determine whether to display the information to the user. If the locality and road match, a determination is made as to whether it is still timely (step 804). Step 804 is performed by comparing the time stamp with the current time. With respect to an accident, the information may still be timely for up to one hour in these examples. If the traffic data packet is still timely, the information is displayed to the user (step 806). In displaying information to the user, the raw data located in the traffic data packet is translated or formatted into a user friendly form for the driver. For example, a driver should not be distracted by a long text message or by trying to figure out the importance of a combination of the use of anti-lock brakes and a windshield wiper in a traffic data packet. Short messages, such as "Accident 4 miles ahead" or "Icy bridge over I30", are examples of messages that would be presented to a user, rather than any raw data from sensors in a vehicle. Additionally, this traffic data may be formatted or translated into a graphical or pictorial message to allow a user to quickly obtain information about traffic conditions. Thereafter, the traffic data packet is rebroadcast by the vehicle for use by other users (step 808) and the process terminates thereafter.

With reference again to step 804, if the traffic data packet is no longer timely, the process terminates. Turning back to step 802, if the locality and the road do not match, a determination is made as to whether the traffic data packet is still timely (step 810). If the traffic data packet is still timely, the process proceeds to step 808 as described above, otherwise, the process terminates without rebroadcasting the traffic data packet. In this manner, the mechanism of the present invention provides timely and geographically relevant traffic information to users. The traffic condition information provided using the mechanism of the present invention provides accuracy in timeliness and geographic relevance that is more useful than current systems, such as those provided by radio stations.

Figure 9:
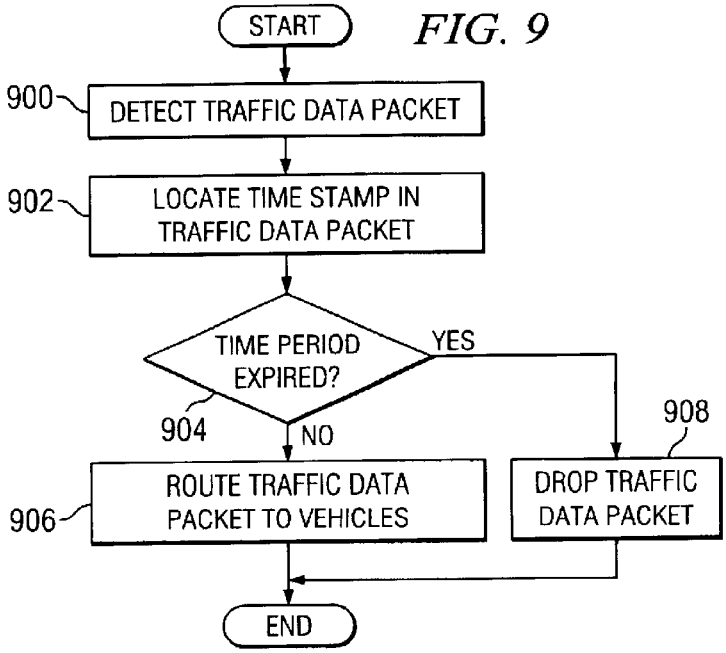
FIG. 9 is a flowchart of a process used for processing traffic data packets in accordance with a preferred embodiment of the present invention.

Turning now to FIG. 9, a flowchart of a process used for processing traffic data packets is depicted in accordance with a preferred embodiment of the present invention. The process illustrated in FIG. 9 may be implemented in a traffic data process, such as traffic data process 400 in FIG. 4, at a server or switch. The process begins by detecting a traffic data packet (step 900). The time stamp in the traffic data packet is located (step 902). A determination is made as to whether the time period has expired (step 904). If the time period has not expired, the traffic data packet is routed to vehicles (step 906) and the process terminates thereafter.

With reference again to step 904, if the time period has expired, the traffic data packet is dropped (step 908) and the process terminates thereafter. Different time periods may be used depending on the type of data present. Also, the routing and dropping of traffic data packets also may be performed using other factors, such as, for example, geographic locations and temperatures. For example, traffic data packets providing information on frozen overpasses may be rebroadcast as long as the temperature is at or below freezing.

Further, if routing as illustrated in FIG. 9 is performed by a server, historical data may be used to add or modify information in the traffic data packets. For example, if the server knows that an accident is typically cleared within 30 minutes at a particular location for which a traffic data packet is received, the packet may be modified to include that data as part of the routing step described in step 906. For example, if a packet received for transmission indicates that an accident occurred an hour ago, the packet may be modified as part of the routing process in step 906 to indicate that an accident occurred but probably will not affect transit times. This modification may occur such that each vehicle may obtain the same message even though several different ways may exist for receiving these messages. Any correlation mechanism for correlating a modified message with an unmodified message may be employed.

Thus, the present invention provides a method, apparatus, and computer implemented instructions for providing information on traffic conditions to travelers. The mechanism of the present invention examines traffic data packets and rebroadcasts these packets or continues routing these packets if the information continues to be timely. In these examples, the timeliness is determined by examining a time stamp included in the traffic data packet. Additionally, other factors, such as geographic location or direction of travel on a particular road may be used to determine whether to present information on traffic conditions to a traveler. In this manner, the mechanism of the present invention provides advantages over currently available radio broadcasts provided by radio stations, which may not be timely or localized enough for a traveler.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. For example, the mechanism of the present invention may be applied to many other types of vehicles other than automobiles or trucks. Airplanes and boats are other types of vehicles to which the mechanism of the present invention may be applied. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a network data processing system for processing traffic information, the method comprising:

detecting traffic related conditions at a plurality of vehicles;

producing a set of traffic data packets using the traffic related conditions detected at the plurality of vehicles, wherein a time stamp and a location stamp are assigned to each of the set of traffic data packets; and passing data traffic packets between vehicles, wherein packets within the set of traffic data packets having an expired time stamp are no longer passed between the vehicles.

2. The method of claim 1 further comprising:

identifying, at each of the plurality of vehicles, selected traffic data packets from the set of traffic data packets, wherein the selected data packets are identified based on the time stamp and the location stamp in each of the set of traffic data packets; and displaying traffic information, at each of the plurality of vehicles, using the selected traffic data packets.

3. The method of claim 1 further comprising:

determining whether historical data is present for the location stamp; and responsive to historical data being present, selectively modifying a traffic data packet containing the location stamp using the historical data.

4. The method of claim 1, wherein the plurality of vehicles includes at least one of an automobile, a truck, an airplane, a helicopter, and a boat.

5. The method of claim 1, wherein the data traffic packets are passed between vehicles using a short distance transmission medium in the network data processing system.

6. The method of claim 1, wherein the short distance transmission medium is a wireless personal area network.

7. The method of claim 1, wherein the traffic related conditions includes at least one of speed of a vehicle, temperature, windshield wiper use, and direction of travel of the vehicle.

8. The method of claim 1, wherein the passing step is performed in at least one of a server computer and a router.

9. A method in a data processing system for handling traffic data, the method comprising:

receiving a set of traffic data packets generated by a plurality of vehicles, wherein the set of traffic data packets includes data on traffic related conditions, a time stamp, and a location stamp;

passing traffic data packets, including the set of traffic data packets, to vehicles until a time out based on an assigned time stamp occurs; and discarding traffic data packets in which a time out based on an assigned time stamp has occurred.

10. The method of claim 9 further comprising:

identifying selected traffic data packets from the set of traffic data packets, wherein the selected data packets are identified based on the time stamp and the location stamp in each of the set of traffic data packets; and displaying traffic information suing the selected traffic data packets.

11. The method of claim 10, wherein the selected traffic data packets are ones having a location stamp for a location within a selected distance of a location of the data processing system.

12. The method of claim 10, wherein the selected traffic data packets are ones having a location stamp with a location on a road on which the data processing system is traveling, within a selected distance of the data processing system, and with a direction coinciding with a direction of travel for the data processing system.

13. The method of claim 9, wherein the plurality of vehicles includes at least one of an automobile, a truck, an airplane, a helicopter, and a boat.

14. The method of claim 9, wherein the data traffic packets are passed between vehicles using a short distance transmission medium in the network data processing system.

15. A data processing system for processing traffic information, the data processing system comprising:

a bus system;

a communications unit connected to the bus system;

a memory connected to the bus system, wherein the memory includes a set of instructions; and a processing unit connected to the bus system, wherein the processing unit executes the set of instructions to detect traffic related conditions at a plurality of vehicles; produce a set of traffic data packets using the traffic related conditions detected at the plurality of vehicles in which a time stamp and a location stamp are assigned to each of the set of traffic data packets; and pass data traffic packets between vehicles in which packets within the set of traffic data packets having an expired time stamp are no longer passed between the vehicles.

16. A data processing system for handling traffic data, the data processing system comprising:

a bus system;

a communications unit connected to the bus system;

a memory connected to the bus system, wherein the memory includes a set of instructions; and a processing unit connected to the bus system, wherein the processing unit executes the set of instructions to receive a set of traffic data packets generated by a plurality of vehicles in which the set of traffic data packets includes data on traffic related conditions, a time stamp, and a location stamp; pass traffic data packets, including the set of traffic data packets, to vehicles until a time out based on an assigned time stamp occurs; and discard traffic data packets in which a time out based on an assigned time stamp has occurred.

17. A network data processing system for processing traffic information, the network data processing system comprising:

detecting means for detecting traffic related conditions at a plurality of vehicles;

producing means for producing a set of traffic data packets using the traffic related conditions detected at the plurality of vehicles, wherein a time stamp and a location stamp are assigned to each of the set of traffic data packets; and passing means for passing data traffic packets between vehicles, wherein packets within the set of traffic data packets having an expired time stamp are no longer passed between the vehicles.

18. The data processing system of claim 17 further comprising:

identifying means for identifying, at each of the plurality of vehicles, selected traffic data packets from the set of traffic data packets, wherein the selected data packets are identified based on the time stamp and the location stamp in each of the set of traffic data packets; and displaying means for displaying traffic information, at each of the plurality of vehicles, using the selected traffic data packets.

19. The data processing system of claim 17 further comprising:

determining means for determining whether historical data is present for the location stamp; and modifying means, responsive to historical data being present, for selectively modifying a traffic data packet containing the location stamp using the historical data.

20. The network data processing system of claim 17, wherein the plurality of vehicles includes at least one of an automobile, a truck, an airplane, a helicopter, and a boat.

21. The network data processing system of claim 17, wherein the data traffic packets are passed between vehicles using a short distance transmission medium in the network data processing system.

22. The network data processing system of claim 17, wherein the short distance transmission medium is a wireless personal area network.

23. The network data processing system of claim 17, wherein the traffic related conditions includes at least one of speed of a vehicle, temperature, windshield wiper use, and direction of travel of the vehicle.

24. The network data processing system of claim 17, wherein the passing step is performed in at least one of a server computer and a router.

25. A data processing system for handling traffic data, the data processing system comprising:

receiving means for receiving a set of traffic data packets generated by a plurality of vehicles, wherein the set of traffic data packets includes data on traffic related conditions, a time stamp, and a location stamp;

passing means for passing traffic data packets, including the set of traffic data packets, to vehicles until a time out based on an assigned time stamp occurs; and discarding means for discarding traffic data packets in which a time out based on an assigned time stamp has occurred.

26. The data processing system of claim 25 further comprising:

identifying means for identifying selected traffic data packets from the set of traffic data packets, wherein the selected data packets are identified based on the time stamp and the location stamp in each of the set of traffic data packets; and displaying means for displaying traffic information suing the selected traffic data packets.

27. The data processing system of claim 26, wherein the selected traffic data packets are ones having a location stamp for a location within a selected distance of a location of the data processing system.

28. The data processing system of claim 26, wherein the selected traffic data packets are ones having a location stamp with a location on a road on which the data processing system is traveling, within a selected distance of the data processing system, and with a direction coinciding with a direction of travel for the data processing system.

29. The data processing system of claim 25, wherein the plurality of vehicles includes at least one of an automobile, a truck, an airplane, a helicopter, and a boat.

30. The data processing system of claim 25, wherein the data traffic packets are passed between vehicles using a short distance transmission medium in the network data processing system.

31. A computer program product in a computer readable medium for processing traffic information, the computer program product comprising:

first instructions for detecting traffic related conditions at a plurality of vehicles;

second instructions for producing a set of traffic data packets using the traffic related conditions detected at the plurality of vehicles, wherein a time stamp and a location stamp are assigned to each of the set of traffic data packets; and third instructions for passing data traffic packets between vehicles, wherein packets within the set of traffic data packets having an expired time stamp are no longer passed between the vehicles.

32. A computer program product in a computer readable medium for handling traffic data, the computer program product comprising:

first instructions for receiving a set of traffic data packets generated by a plurality of vehicles, wherein the set of traffic data packets includes data on traffic related conditions, a time stamp, and a location stamp;

second instructions for passing traffic data packets, including the set of traffic data packets, to vehicles until a time out based on an assigned time stamp occurs; and third instructions for discarding traffic data packets in which a time out based on an assigned time stamp has occurred.

* * * * *